US010053848B2

(12) United States Patent
Lee

(10) Patent No.: US 10,053,848 B2
(45) **Date of Patent: *Aug. 21, 2018**

(54) ADJUSTMENT UNIT OF UNPOWERED AUTOMATIC WATER FLUSHING TOILET BOWL SEAT HAVING FUNCTION OF CONTROLLING AIR DISCHARGE AND INTAKE ONLY BY BODY WEIGHT

(71) Applicant: Dong Jin Lee, Seoul (KR)

(72) Inventor: Dong Jin Lee, Seoul (KR)

(73) Assignee: Dong Jin Lee, Seoul (KR)

( * ) Notice: Subject to any disclaimer, the term of this patent is extended or adjusted under 35 U.S.C. 154(b) by 142 days.

This patent is subject to a terminal disclaimer.

(21) Appl. No.: 14/915,986

(22) PCT Filed: Sep. 1, 2014

(86) PCT No.: PCT/KR2014/008114

§ 371 (c)(1),
(2) Date: Mar. 28, 2016

(87) PCT Pub. No.: WO2015/034221

PCT Pub. Date: Mar. 12, 2015

(65) Prior Publication Data

US 2016/0208472 A1 Jul. 21, 2016

(30) Foreign Application Priority Data

Sep. 3, 2013 (KR) ..... 10-2013-0105626

(51) Int. Cl.
*E03D 5/04* (2006.01)

(52) U.S. Cl.
CPC ..... *E03D 5/04* (2013.01)

(58) Field of Classification Search
CPC .... E03D 5/04; E03D 9/05; E03D 5/02; E03D 5/024; E03D 5/028; E03D 5/08; E03D 5/022; E03D 5/105; A47K 13/24
USPC ..... 4/250, 408, 409
See application file for complete search history.

(56) References Cited

U.S. PATENT DOCUMENTS 584,425 A * 6/1897 Strachan ..... E03D 5/04 4/246.4
627,357 A * 6/1899 Smith ..... E03D 3/04 251/17
631,097 A * 8/1899 Solomon ..... E03D 5/04 251/229

(Continued)

FOREIGN PATENT DOCUMENTS

KR 2000017025 9/2000
KR 20060049402 5/2006

(Continued)

OTHER PUBLICATIONS

International Search Report—PCT/KR2014/008114 dated Nov. 28, 2014.

*Primary Examiner* — Benjamin R Shaw
(74) *Attorney, Agent, or Firm* — Cantor Colburn LLP

(57) ABSTRACT

Provided is an adjustment unit of an unpowered automatic water flushing toilet bowl seat having a function of controlling air discharge and intake only by body weight, which can adjust a water flushing time when excrement is cleaned while interworking with a rising operation of a toilet bowl seat moved by weight of a toilet user.

5 Claims, 22 Drawing Sheets

(56) References Cited

U.S. PATENT DOCUMENTS 858,427 A * 7/1907 Thompson ..... E03D 9/05 4/215
924,988 A * 6/1909 Henning ..... E03D 9/05 4/216
931,713 A * 8/1909 Allingham ..... E03D 5/04 251/232
963,440 A * 7/1910 Hodgson ..... E03D 5/04 4/250
975,664 A * 11/1910 Watrous ..... E03D 3/04 251/17
975,812 A * 11/1910 Watrous ..... E03D 5/04 4/240
1,004,349 A * 9/1911 Bensen ..... E03D 3/04 251/21
1,013,616 A * 1/1912 Rumsey ..... E03D 9/05 4/216
1,015,132 A * 1/1912 Bower ..... F16K 11/044 137/625.27
1,045,433 A * 11/1912 Payne ..... F16K 3/26 137/625.26
1,048,867 A * 12/1912 Payne ..... E03D 3/06 251/18
1,062,412 A * 5/1913 Payne ..... E03D 5/022 4/250
1,073,603 A * 9/1913 Hansen ..... E03D 5/04 251/322
1,257,331 A * 2/1918 Duff ..... E03D 9/05 4/215
1,339,585 A * 5/1920 Sloan ..... E03D 5/04 4/250
1,449,439 A * 3/1923 Phillips ..... E03D 5/04 4/213
5,369,816 A * 12/1994 Chen ..... E03D 5/04 4/405
2007/0044216 A1* 3/2007 Cosby ..... A47K 13/10 4/246.1
2016/0160486 A1* 6/2016 Shin ..... E03D 5/04 4/408

FOREIGN PATENT DOCUMENTS

KR 100811461 3/2008
KR 20100022781 3/2010
KR 101071981 10/2011
KR 20120004003 1/2012

* cited by examiner

ADJUSTMENT UNIT OF UNPOWERED AUTOMATIC WATER FLUSHING TOILET BOWL SEAT HAVING FUNCTION OF CONTROLLING AIR DISCHARGE AND INTAKE ONLY BY BODY WEIGHT

TECHNICAL FIELD

The present invention relates to an unpowered automatic water flushing toilet bowl seat and, more particularly, to an adjustment unit of an unpowered automatic water flushing toilet bowl seat having a function of controlling air discharge and intake only by a user's body weight, the toilet seat being able to adjust flushing time for removing excreta in response to upward movement of a toilet bowl seat that is moved by the weight of a user.

BACKGROUND ART

In general, a toilet is designed to discharge excreta with washing water supplied when a lever is operated to a sewage disposal tank after a user uses an indoor toilet, but recently, a "Device for non-power auto-flush of chamber pot" that automatically flushes using water pressure rather than a lever has been disclosed in Korean Patent Application Publication No. 10-2010-0022781.

According to this patent document, when a user sits on a toilet seat, water is supplied to an operation unit from a hydrant through a water pipe opened by the weight of the user, a cylinder rod is pressed and moved while compressing a spring by the pressure of the water supplied to the operation unit, and whether the waste from the user is urine or feces is determined in accordance with the movement distance of the cylinder rod. Thereafter, when the user stands up, the water moving the cylinder rod is supplied to a flushing unit by restoring force of the compressed spring, whereby flushing water corresponding to the excrement is discharged and removes the excrement.

However, according to the patent document, when the pressure of the water supplied from a hydrant is lower than the tension of the spring, the cylinder is not pressed and moved, it is difficult to determine whether the waste from the user is urine or feces and flushing is not appropriately performed.

Further, even if the pressure of water that is supplied from a hydrant is normal, when excrement is simultaneously discharged from a plurality of toilets, water pressure is distributed and weakened, so the cylinder rod cannot be moved to the position where excreta is determined and flushing water for urine is discharged. Accordingly, the toilets are clogged with remaining excreta or an offensive odor is caused with unsanitary problems. Further, it is troublesome to have to flush by manually operating the lever to remove the remaining excreta.

Further, the operation unit that is operated by water pressure is complicated, so productivity is low, and there are many parts, so water leaks at their joints or dirt is accumulated in the pipes, which causes malfunction.

Recently, for solving the problems, there is Korean Patent No. 10-1071981, titled "Body weight by dividing the energy-only feces toilet seat capable of automatic water in".

According to this document, when a user sits on the toilet seat, the toilet seat is moved down by the weight of the user, the gap between first and second loading rollers decreases, tension of a loading wire is removed, and a loading wire-fixing member fixed to the loading wire is locked to a separation member on a flushing wire-fixing member fixed to an end of a flushing wire by a restoring force of a loading spring. When a moving contact member that moves while pressing fluid with downward movement of the toilet seat presses an excreta determining unit, the excreta is determined as urine, and when a cylinder rod presses the excreta determining unit, the excreta is determined as feces. When the user stands up from the toilet seat, the amount of fluid is adjusted in accordance with opening/closing of a hole depending on the determined urine or feces, the toilet seat is returned, the gap between the first and second loading rollers is increased, and the loading wire is tensed and pulls the flushing wire-fixing member and the flushing wire, so flushing water corresponding to the excreta is discharged into the toilet body and removes the excreta.

However, according to this configuration, when fluid is supplied to a cylinder in accordance with the weigh of the user who sits on and stands up from the toilet seat, the fluid flows through a complicated system and there are many parts, so assembling is difficult and the manufacturing cost is high, which deteriorates economical efficiency.

Further, maintenance is difficult and a defective proportion is high due to possibility of leaking of the fluid at the joints of the parts, and the operation time depends on the amount of injected oil and a viscosity difference according to a temperature difference, so malfunction frequently occurs. Furthermore, water is not supplied or keeps being supplied due to an on/off error of a separate pipe valve, so reliability of the product is deteriorated.

DISCLOSURE

Technical Problem

The present invention has been made in consideration of the problems of the related art and an object of the present invention is to provide an adjustment unit of an unpowered automatic water flushing toilet bowl seat having a function of controlling air discharge and intake only by body weight, the toilet seat being able to adjust flushing time for removing excreta in response to upward movement of a toilet bowl seat that is moved by the weight of a user and that has a simple configuration for adjusting the flushing time, thereby reducing the number of parts and the manufacturing cost with simple assembling.

Another object of the present invention is to provide an adjustment unit of an unpowered automatic water flushing toilet bowl seat having a function of controlling air discharge and intake only by a user's body weight, the toilet seat being able to prevent malfunction due to oil leakage and a temperature change of fluid and adjust flushing time by adjusting the amount of air that is sucked inside.

Technical Solution

An aspect of the present invention provides an adjustment unit of an unpowered automatic water flushing toilet bowl seat having a function of controlling air discharge and intake only by a user's body weight, in an automatic flushing device that senses a user through seat springs compressed by the weight of the user when the user sits on a toilet seat and automatically removes excreta using water from a hydrant and a water tank while the toilet seat is restored by restoring force of the seat springs when the user stands up from the toilet seat. The adjustment unit includes: an adjusting body fixed to the toilet seat and having an air exhaust hole for sucking and discharging air in response to upward and downward movement of the toilet seat; a cover member opening and closing the air exhaust hole; an anti-separation member preventing separation of the cover member; and a vertical guide member fixed to a body sensing unit to discharge air in the adjusting body and suck air outside the adjusting body by moving up and down in the adjusting body.

Advantageous Effects

According to the present invention, it is possible to adjust flushing time for removing excreta in response to upward movement of a toilet bowl seat that is moved by the weight of a user and that has a simple configuration for adjusting the flushing time, thereby reducing the number of parts and the manufacturing cost with simple assembling and improving economical efficiency.

Further, according to the present invention, it is possible to prevent malfunction due to oil leakage and a temperature change of fluid and adjust flushing time by adjusting the amount of air that is sucked inside, so the adjustment unit is useful.

Figure 1:
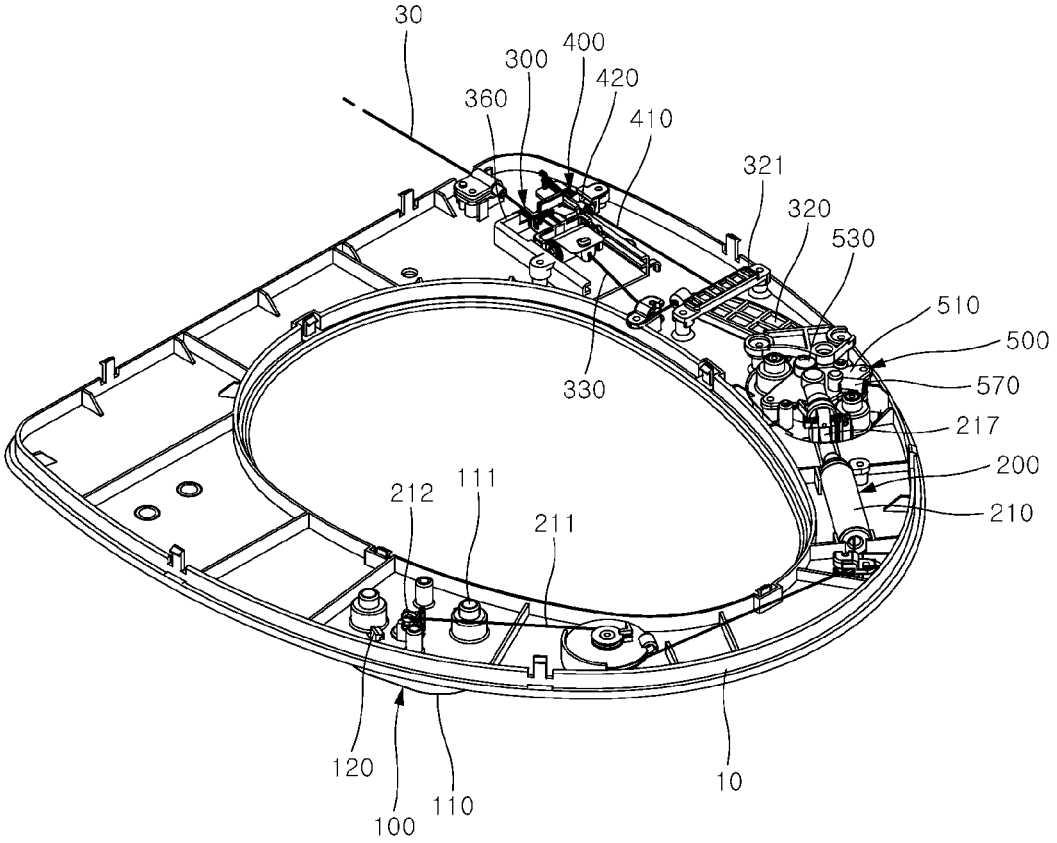
FIG. 1 is a perspective view of a toilet bowl seat of the present invention.

<Description of the Reference Numerals in the Drawings>

| | |
|---|---|
| 100, 100': Body sensing unit | 110: Sensing plate |
| 120: Hook | 130: Seat spring |
| 200: Excreta discriminating unit | |
| 210: Cylinder body | 300: Operation unit |
| 310: Pressing member | 320: Lever |
| 330: Loading wire | 340: Loading member |
| 350: Loading guide | |
| 360: Loading guide-guiding member | |
| 400: Unloading unit | 410: Unloading wire |
| 420: Unloading wire-fixing member | |
| 430: Unloading wire-supporting member | |
| 440: Unloading member | 450: Loading projection |
| 500: Adjustment unit | 510: Adjusting body |
| 520: Cover member | |
| 530: Anti-separation member | |
| 540: Vertical guide member | 550: Air adjusting filter |
| 560: Bolt | |
| 570: Toilet paper-disposal time adjuster | |

MODE FOR INVENTION

Figure 2:
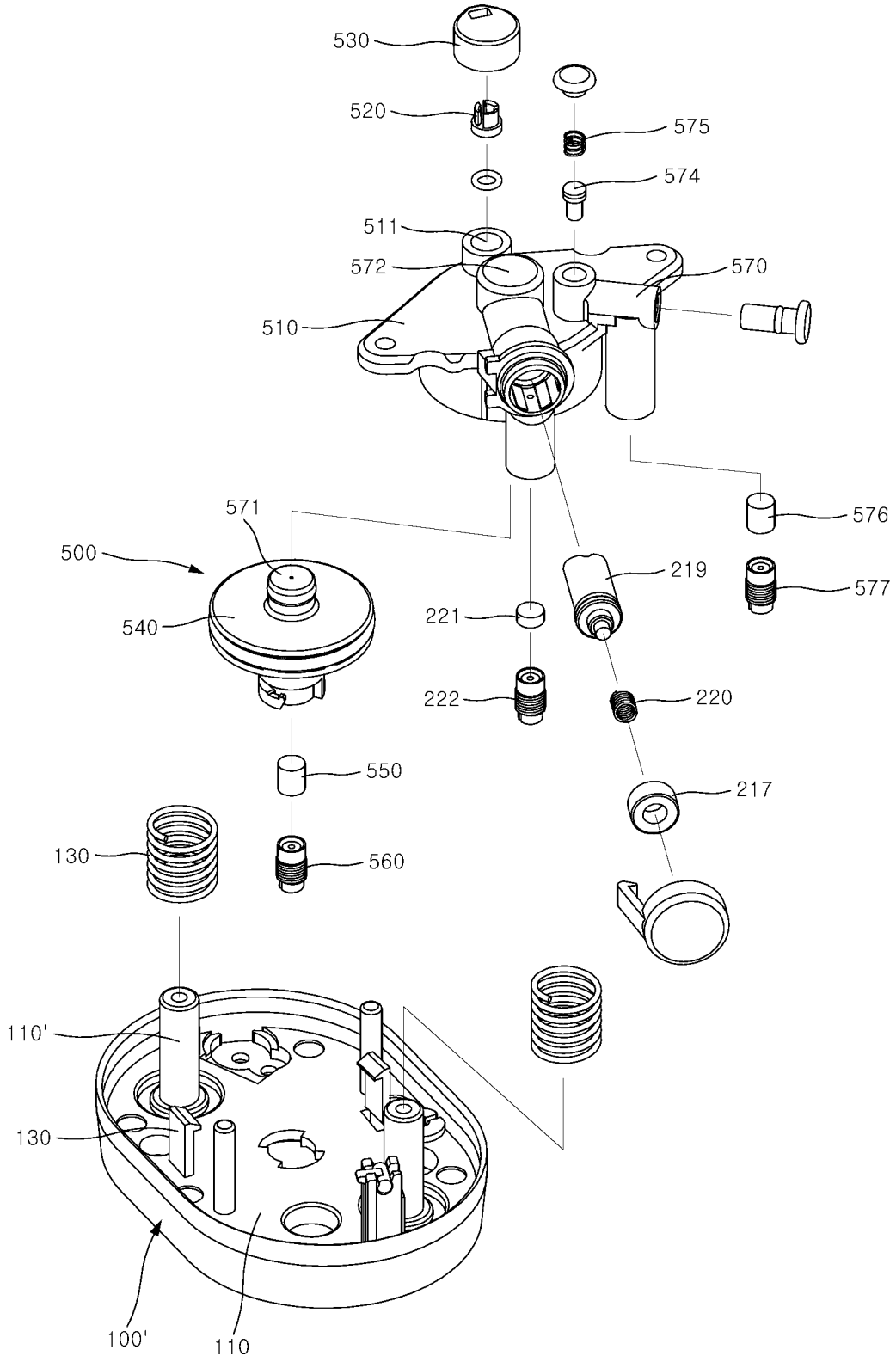
FIG. 2 is an exploded perspective view of the present invention.

The present invention is described hereafter in detail with reference to the accompanying drawings. FIG. 1 is a perspective view of a toilet bowl seat of the present invention and FIG. 2 is an exploded perspective view of the present invention.

The present invention provides an adjustment unit of an unpowered automatic water flushing toilet bowl seat having a function of controlling air discharge and intake only by a user's body weight, in an automatic flushing device of the present invention that senses a user through seat springs 130 compressed by the weight of the user when the user sits on a toilet seat 10 and automatically removes excreta using water from a hydrant and a water tank while the toilet seat 10 is restored by restoring force of the seat springs 130 when the user stands up from the toilet seat 10. The adjustment unit 500 includes: an adjusting body 510 fixed to the toilet seat 10 and having an air exhaust hole 511 for sucking and discharging air in response to upward and downward movement of the toilet seat 10; a cover member 520 opening/closing the air exhaust hole 511; an anti-separation member 530 preventing separation of the cover member 520; and a vertical guide member 510 fixed to a body sensing unit 100' to discharge air in the adjusting body 510 and suck air outside the adjusting body 510 by moving up and down in the adjusting body 510, which is described in detail hereafter.

The adjustment unit 500 further includes an air adjusting filter 550 coupled to a hole 541 formed through the vertical guide member 540 to adjust the amount of air flowing inside through the hole 541 and a bolt 560 inserted in the hole 541 to prevent separation of the air adjusting filter 550 and adjust the movement amount of the air in accordance with the degree of compression of the air adjusting filter 550.

The adjustment unit 500 further includes a toilet paper-disposal time adjuster 570 that adjusts the time for a user to dispose toilet paper by adjusting the downward movement time of the vertical guide member 540. The toilet paper-disposal time adjuster 570 has a toilet paper time-adjusting rib 571 protruding on the top of the vertical guide member 540, a rib groove 572 formed on the adjusting body 510 to receive the toilet paper time-adjusting rib 571, a toilet paper time-adjusting hole 573 formed through the adjusting body 510, and a toile paper time-adjusting cover member 574 inserted in the toilet paper time-adjusting hole 573 so that the toilet paper time-adjusting rib 571 opens/closes the toilet paper time-adjusting hole 573 by being coupled to and separated from the rib groove 572.

The toilet paper-disposal time adjuster 570 further has a restoring member 575 for restoring the toilet paper time-adjusting cover member 574.

The toilet paper-disposal time adjuster 570 further includes an air adjusting filter 576 coupled to an end of the toilet paper time-adjusting hole 573 to adjust the amount of air sucked through the toilet paper time-adjusting hole 573, and a toilet paper time-adjusting bolt 577 being a hollow body for guiding air, coupling to the toilet paper time-adjusting hole 573, and preventing separation of the air adjusting filter 576.

The present invention having the configurations described above is described hereafter in detail.

First, the present invention can be operated only with the body sensing unit 100 and 100', the operation unit 300, and the unloading unit 300 and only with the body sensing unit 100 and 100', the operation unit 300, the unloading unit 400, and the adjustment unit 500, but the present invention is described hereafter in limitation to the configuration including the body sensing unit 100 and 100', the excreta discriminating unit 200, the operation unit 300, the unloading unit 400, and the adjustment unit 500.

Figure 3:
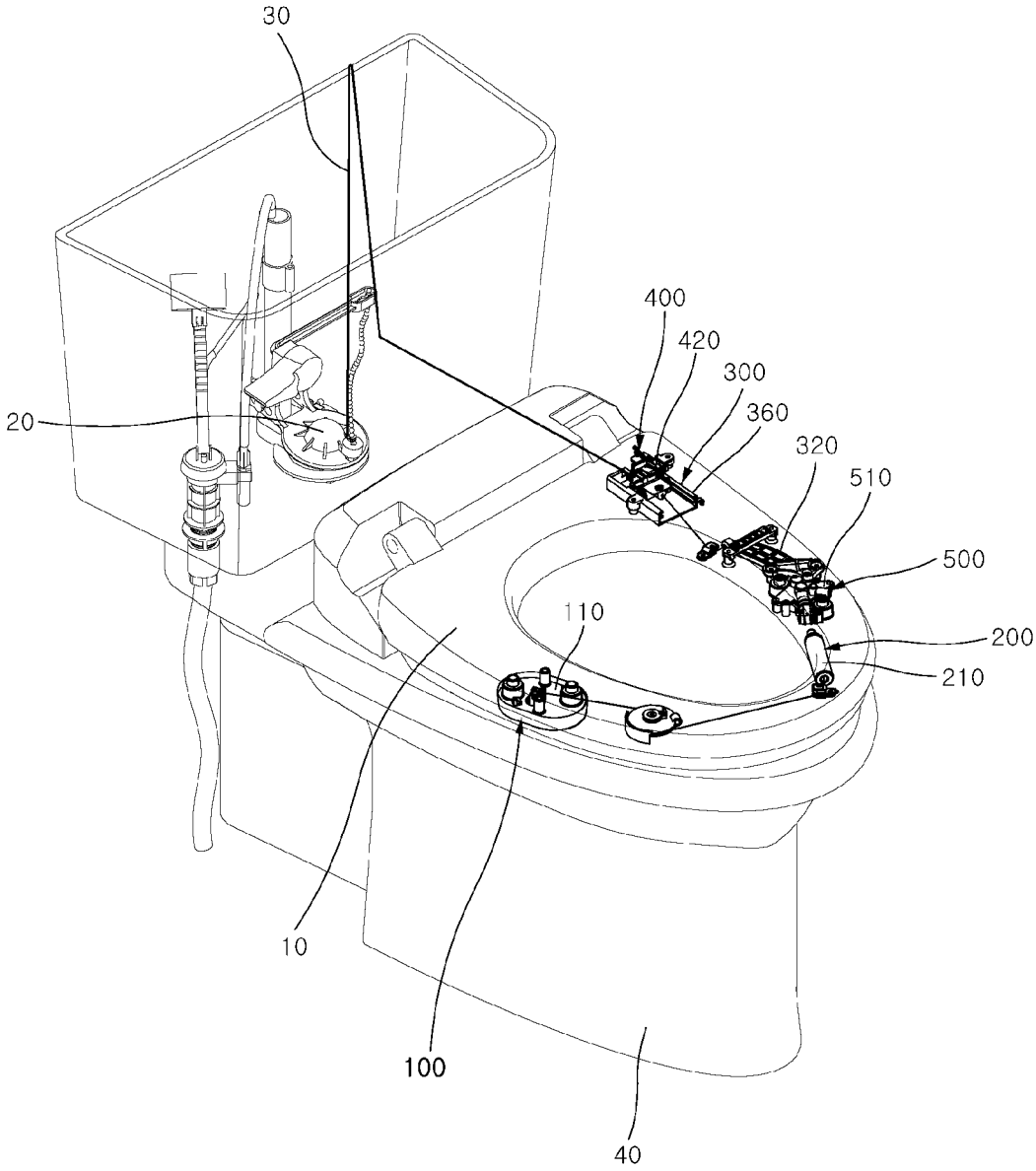
FIG. 3 is a perspective view showing an installed state of the present invention.

As shown in FIG. 3, the body sensing unit 100 and 100', the operation unit 300, the unloading unit 400, the adjustment unit 500, and the excreta discriminating unit 200 are installed in the toilet seat 10, in which the operation unit 300 is controlled by the unloading unit 400, the toilet seat 10 is placed on a toilet body 11, and the operation unit 300 and the siphon cover 200 are connected by the flushing wire 30.

Figure 4:
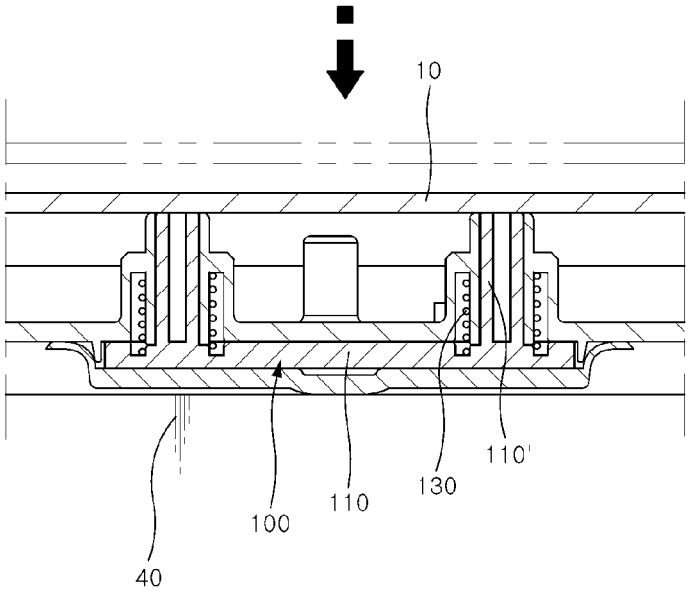
FIGS. 4 to 14 are views showing operation with a user sitting on the toilet seat of the present invention.
Figure 5:
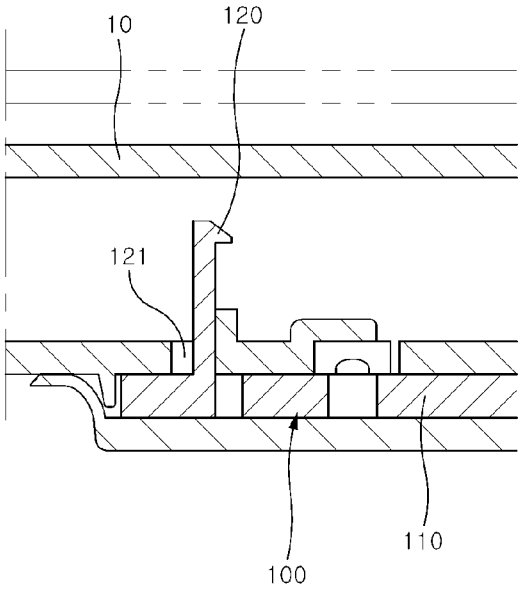
Figure 6:
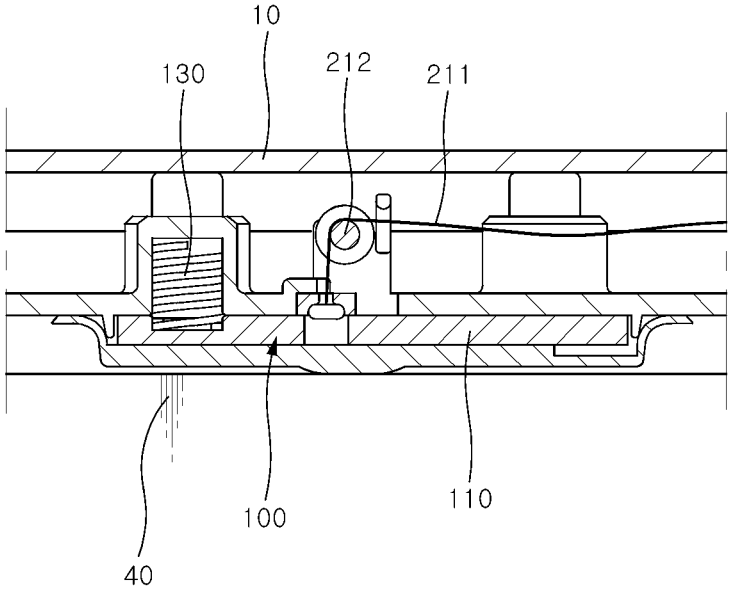
Figure 7:
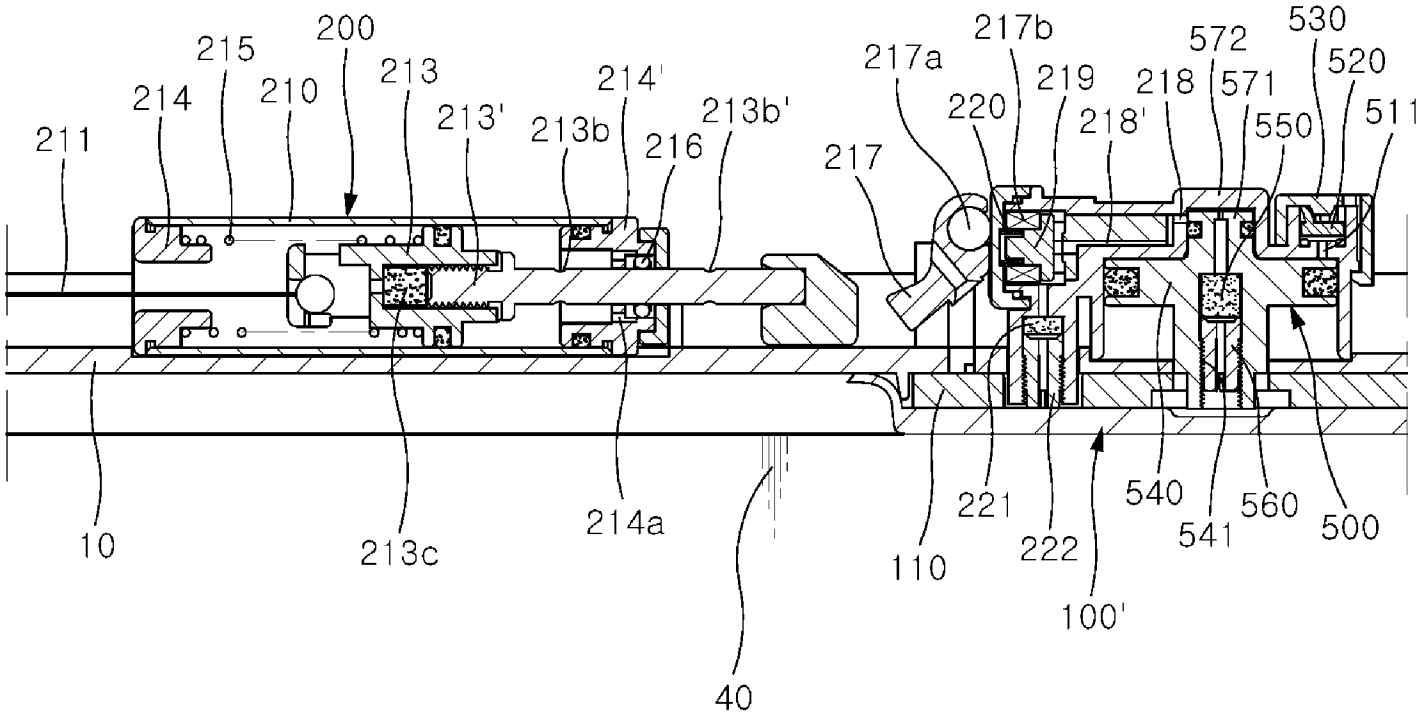
Figure 8:
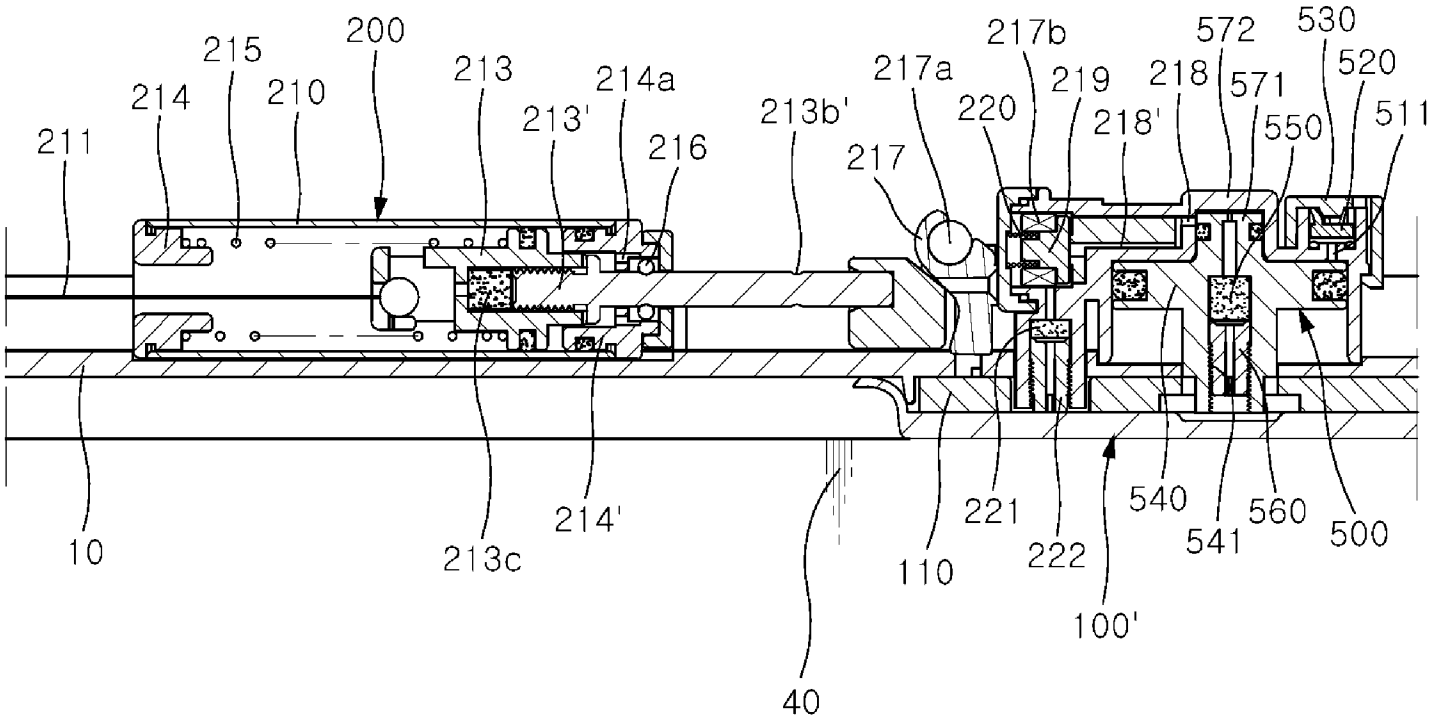
Figure 9:
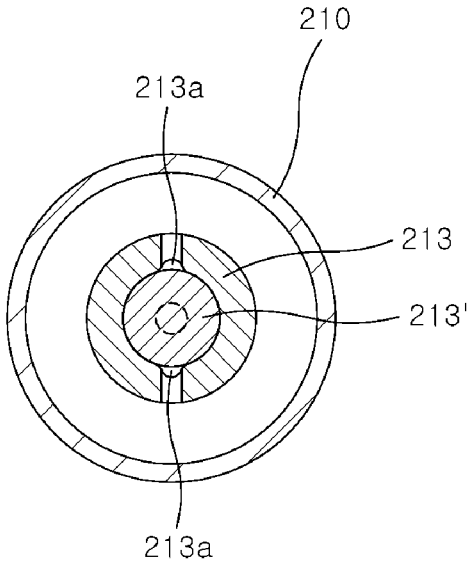

When a user sits on the toilet seat 10, as shown in FIGS. 4 and 5, the toilet seat 10 is moved by the weight of the user, the projection 110' and the hook 120 of the sensing plate 121 protrude through the hole 111 and the hook hole 121 of the body sensing unit 100 and 100' formed through the toilet seat 10, and the seat springs 130 between the toilet seat 10 and the sensing plate 110 are compressed.

Further, as the seat springs 130 between the toilet seat 10 and the sensing plate 110 are compressed, as shown in FIGS. 6 to 10, the gap between the toilet seat 10 and the body sensing unit 100 decreases, the tension of the cylinder wire 211 for the excreta discriminating unit 200 of which the first end is fixed to the body sensing unit 100 is removed, and the cylinder wire 211 with the tension removed rotates the roller 212 using the restoring force of the compressed cylinder spring 215 and moves the rod pin 213 and the cylinder rod 213' to a second side of the cylinder body 210.

The cylinder spring 215 can press the rod pin 213 using a restoring force, between the rod pin 213 and the first cap 214 at a first side of the cylinder body 210 and the cylinder rod 313' protrudes through the second cap 214' at the second side of the cylinder body 210.

As the cylinder rod 213' is moved, the packing 216 is moved over the coupling groove **213*b*' toward the coupling groove 213*b*, in which the packing 216 closes the inner side of the second cap 214' and the groove 214*a*, thereby blocking air flowing inside. Further, as the cylinder rod 213' is moved, the amount of the air flowing into the cylinder body 210 through the first cap 214 can be adjusted in accordance with the degree of compression of the air adjusting filter 213*c* disposed between the rod pin 213 and the cylinder rod 213', so the speed of the cylinder rod 213'** can be adjusted.

If the cylinder rod 213' moved by the restoring force of the cylinder spring 215 cannot pressure the excreta mode-switching member 217 and accordingly the contact member in the excreta mode-switching member 217 and the contact member **217*b* in the urine adjusting hole 218 keep in contact with each other, the excreta is determined as urine. On the contrary, if the cylinder rod 213' is moved and presses the excreta mode-switching member 217 and accordingly the contact member in the excreta mode-switching member 217 and the contact member 217*b* in the urine adjusting hole 218 are separated from each other, the excreta is determined as feces. This is because as the contact members 217*a* and 217*b* are separated from each other or brought in contact with each other, the urine cover member 219 is moved and closes the urine adjusting hole 218 by the restoring force of the restoring member 220, and when the user stands up from the toilet seat 10, the amount of air flowing into the adjusting body 510** is adjusted.

Figure 11:
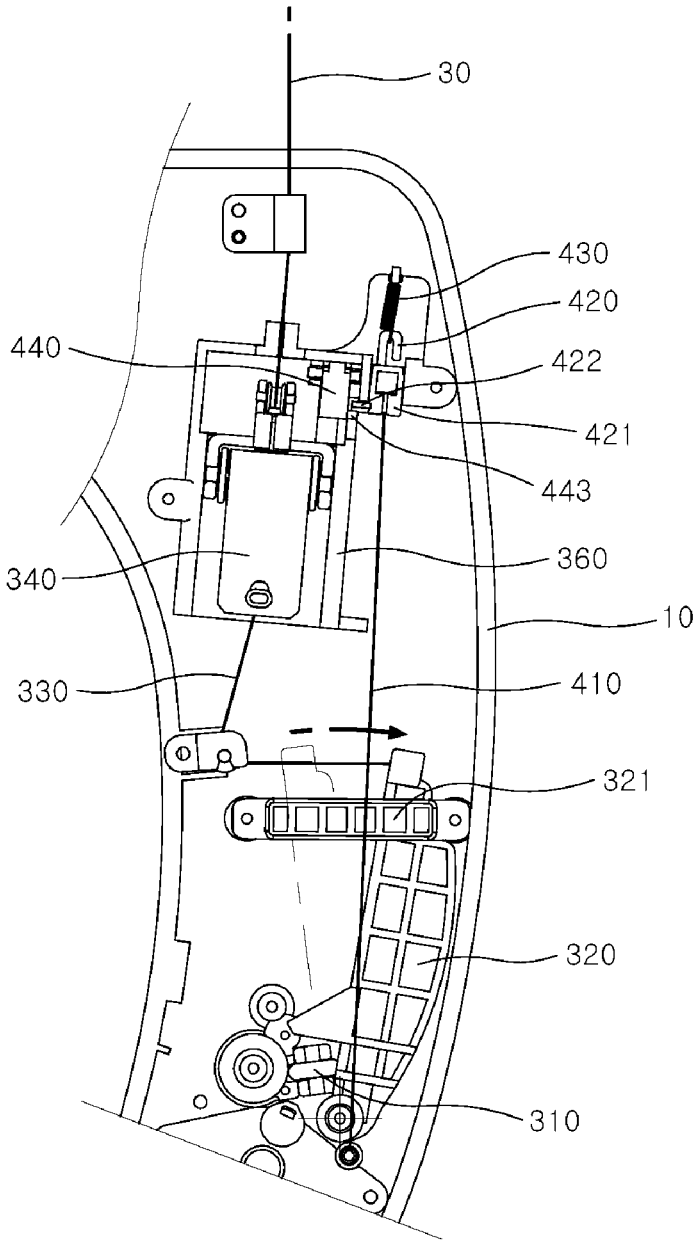
Figure 12:
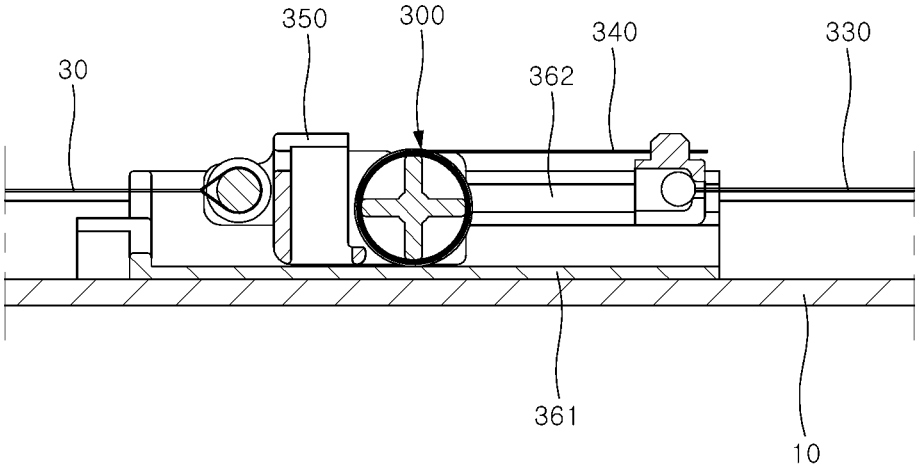

Further, as shown in FIGS. 11 and 12, the pressing member 310 of the operation unit 300 on the sensing plate 110 of the body sensing unit 100' protrudes into the toilet seat 10 and presses the lever 320.

Since the outer side of the pressing member 310 is curved or inclined, so it can press the lever 320, and when lever 320 is pressed by the pressing member 310, the lever 320 is rotated from a first side to a second side about an end.

The lever 320 can be rotated only in the rotational unloading member 321 accommodating the lever 3320 and fixed to the toilet seat 10.

As the lever 320 is rotated, the loading wire 330 connecting the lever 320 and the loading member 340 is pulled and pulls the loading member 340, in which the loading member 340 may be any one of a spiral spring, a leaf spring, and a coil spring.

When the loading member 340 stretches, only the loading member 340 stretches and the loading force of the flushing wire 30 is kept, because the unloading projection 442 of the unloading member 440 is locked to the loading projection 450 of the loading guide 350 for guiding the loading member 340.

Figure 13:
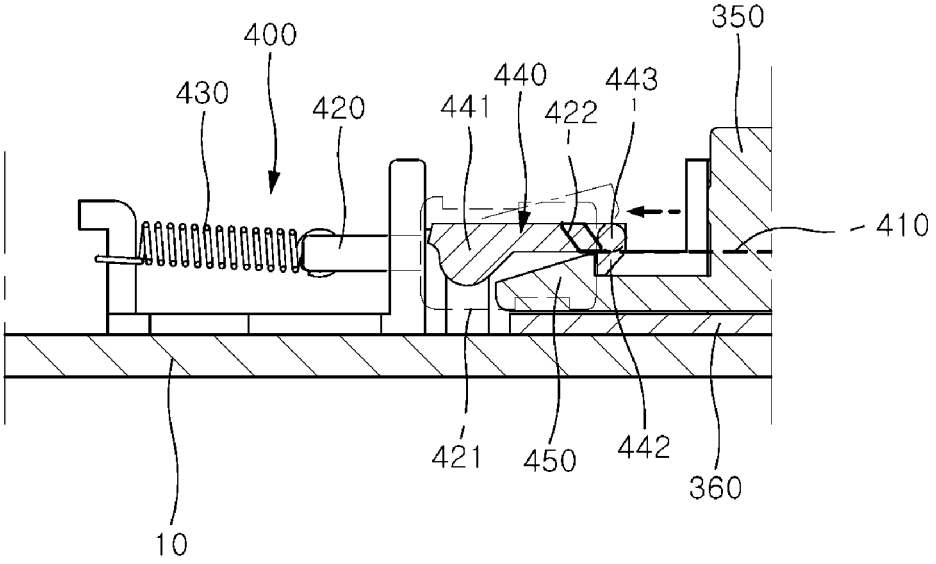

Further, as shown in FIG. 13, when the gap between the toilet seat 10 and the body sensing unit 100' decreases and the tension of the unloading wire 410 of the unloading unit 400 fixed at the first end to the body sensing unit 100' is removed, the unloading wire-fixing body 421 of the unloading wire-fixing member 420 and the unloading wire 410 are pulled by the restoring force of the unloading wire-supporting member 430 connecting the loading guide-guiding member 360 and the unloading wire-fixing member 420 so that the tension of the unloading wire 410 is maintained.

The unloading wire-fixing body 421 of the unloading wire-fixing member 420 pulled by the restoring force of the unloading wire-supporting member 430 moves toward the unloading wire-supporting member 430, whereby the unloading wire projection 422 protruding on the unloading wire-fixing body 421 comes in close contact with the unloading wire projection 443 of the unloading member 440. Further, even in this state, the unloading wire-fixing body 421 is moved toward the unloading wire-supporting member 430 by the restoring force of the unloading wire-supporting member 430 and the unloading wire projection 422 is moved upward along the unloading sire projection 443, and when the unloading wire projection 422 passes the unloading wire projection 443, it is moved back downward by its own weight, the unloading wire projection 422 is positioned behind the unloading wire projection 443.

Figure 10:
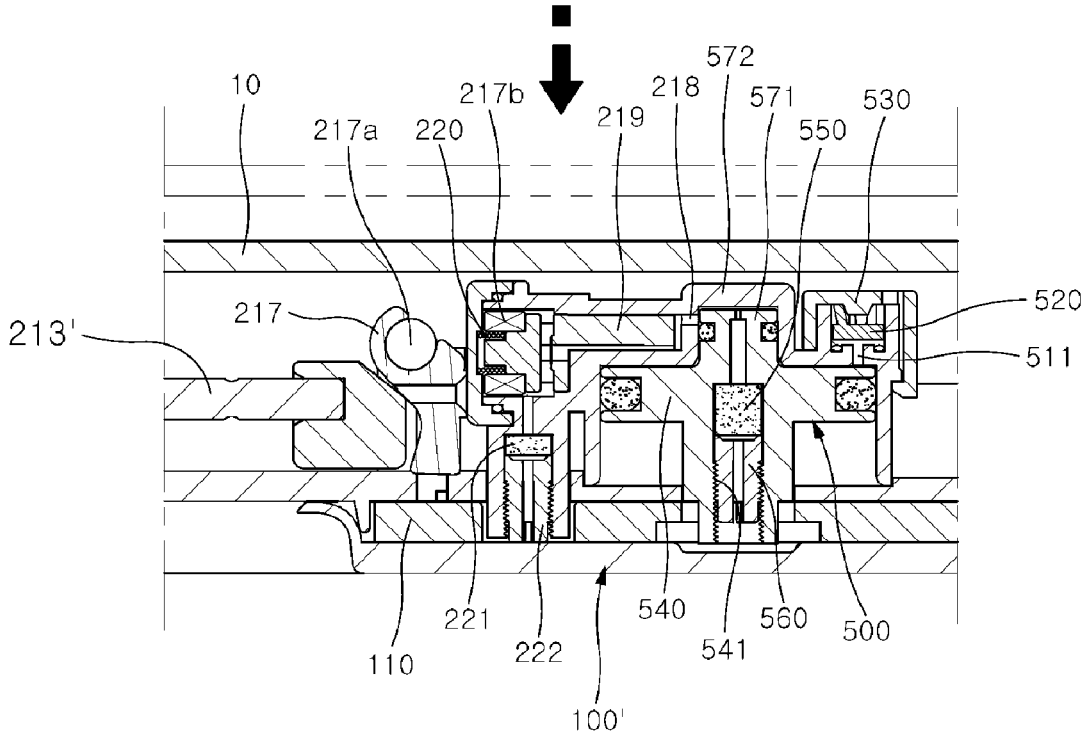
Figure 14:
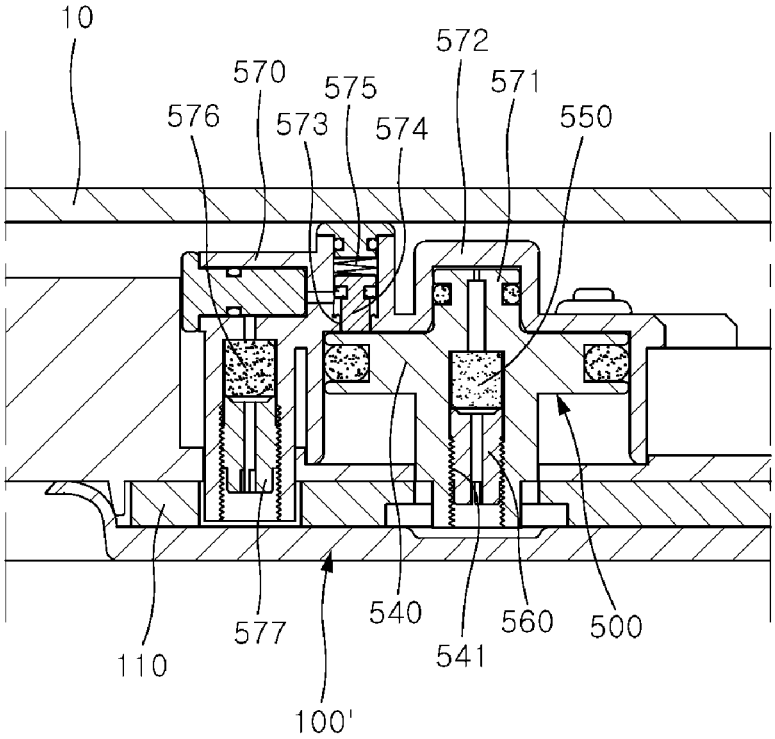

Further, as shown in FIGS. 10 and 14, as the gap between the toilet seat 10 and the body sensing unit 100' decreases, the vertical guide member 540 of the adjustment unit 500 fixed to the body sensing unit 100' moves to the top inside the adjusting body 510 and compresses the air inside the adjusting body 510, and the compressed air presses the cover member 520, passes through the open air exhaust hole 511, and is discharged to the outside through the anti-separation member 530.

As the vertical guide member 540 is moved to the top inside the adjusting body 510, the toilet paper-adjusting rib 571 of the toilet paper time-adjuster 570 is fitted into the rib groove 572, the vertical guide member 540 moved to the top inside the adjusting body 510 presses the toilet paper time-adjusting cover member 574, the toilet paper time-adjusting cover member 574 compresses the restoring member 575, moves to the top inside the adjusting body 510, and opens the toilet paper time-adjusting hole 573, and the air inside the adjusting body 510 is discharged outside through the open toilet paper time-adjusting hole 573.

When the toilet paper time-adjusting rib 571 is fitted into the rib groove 572, the air in the rib groove 572 is discharged outside the adjusting body 510 through the urine adjusting hole 218. The urine adjusting hole 218 has been closed by the urine cover member 219 by the restoring force of the restoring member 220, but, as the pressure of the air inside the rib groove 572 is increased, the urine cover member 219 and the restoring member 220 are pushed and the urine adjusting hole 218 is opened. Further, since the air guide groove 218' is formed on the urine adjusting hole 218, the air inside the rib groove 572 can be discharged outside even though the urine cover member 219 is inserted in the urine adjusting hole 218.

It is possible to adjust the amount of the air that is discharged through the toilet paper time-adjusting hole 573 and the urine adjusting hole 218 in accordance with the compressed degree of the air adjusting filters 576 and 221 by the toilet paper time-adjusting bolt 577 and the urine adjusting bolt 222 inserted in the toilet paper time-adjusting hole 573 and the urine adjusting hole 218, using the air adjusting filters 576 and the 221 in the toilet paper time-adjusting hole 573 and the urine adjusting hole 218.

Figure 15:
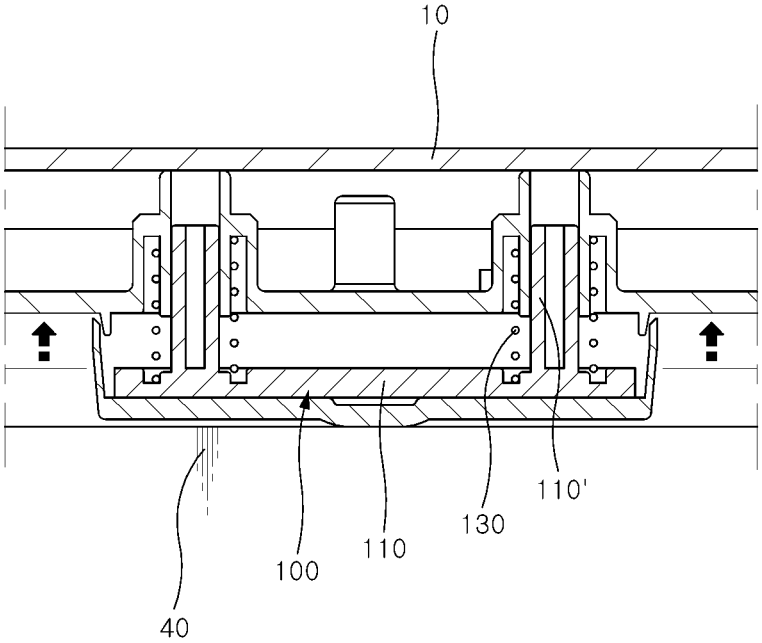
FIGS. 15 to 26 are views showing operation when a user stands up from the toilet seat of the present invention.
Figure 16:
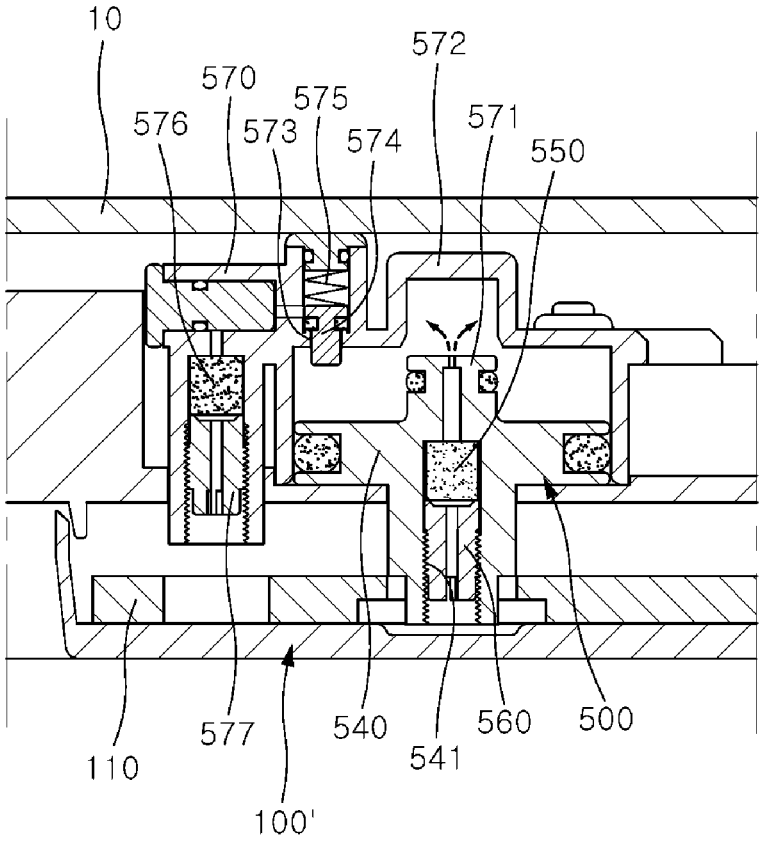
Figure 17:
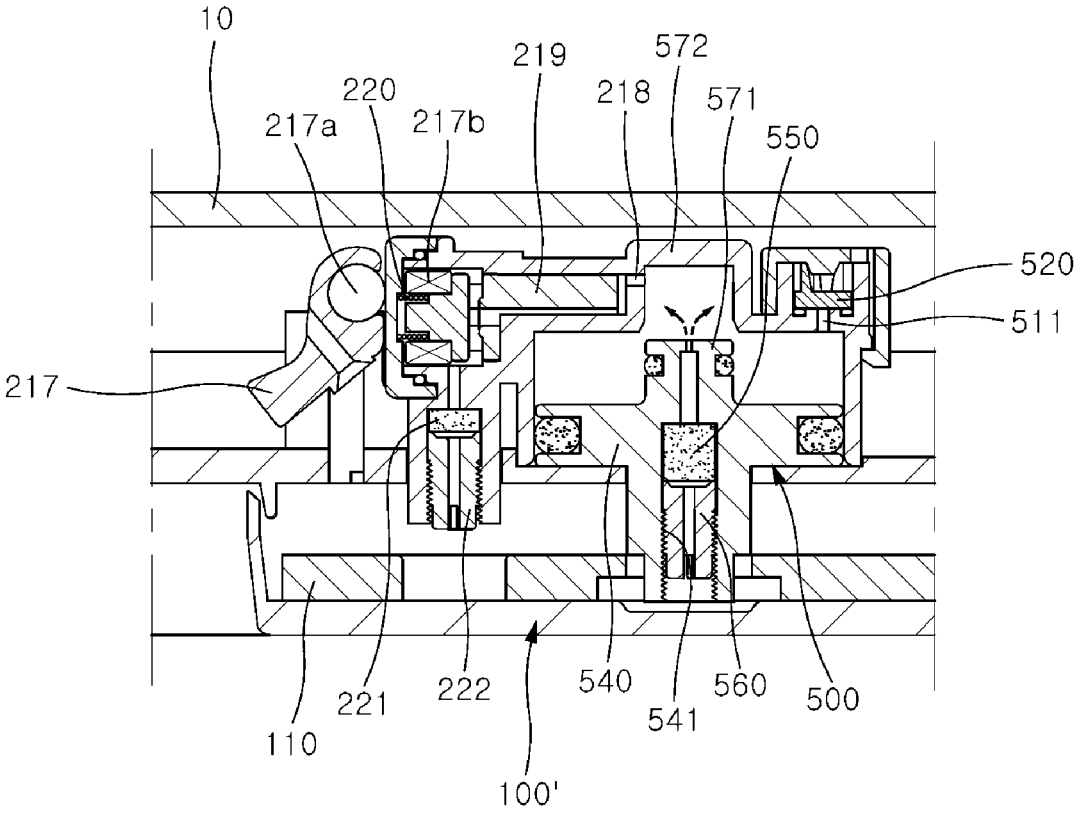

When the user stands up from the toilet seat 10 after excreting on the toilet seat 10, as shown in FIG. 15, the gap between the toilet seat 10 and the body sensing unit 100 and 100' is increased by restoring force of the seat springs 130 of the body sensing unit 100 and 100', and as shown in FIGS. 16 and 17, the vertical guide member 540 fixed to the body sensing unit 100' is moved to the bottom inside the adjusting body 510 and the pressure inside the adjusting body 510 is reduced, so the air outside the adjusting member 510 is sucked.

Since the air exhaust hole 511 of the adjusting body 510 is closed by the cover member 520, the external air cannot be sucked, so the toilet paper time-adjusting rib 571 protruding on the top of the adjusting body 510 is moved to the lower end of the rib groove 572 and the external air is sucked inside through the urine adjusting hole 218, the toilet paper time-adjusting hole 573, and the hole 541. In this process, since the air adjusting filters 221, 550, and 576 are disposed in the urine adjusting hole 218, the hole 541, and the toilet paper time-adjusting hole 573 by the urine adjusting bolt 222, the bolt 560, and the toilet paper time-adjusting bolt 577, so the amount of air can be adjusted in accordance with the compressed degree of the air adjusting filters.

A sealing member (not shown) is disposed on the inner side of the rib groove 572 for the toilet paper time-adjusting rib 571 and delays the time when the toilet paper time-adjusting rib 571 is separated from the rib groove 572, and the delayed time is the time that the user takes to dispose toilet paper.

As the toilet paper time-adjusting rib 571 is separated from the rib groove 572, the toilet paper time-adjusting cover member 574 with the pressing force by the vertical guide member 540 removed is moved down and closes the toilet paper time-adjusting hole 573 by the restoring force of the restoring member 575 and the restoring time of the vertical guide member 540 is delayed in accordance with the amount of the air sucked through the urine adjusting hole 218, in which the restoring time of the vertical guide member 540 is the operation time of the operation unit 300.

Figure 18:
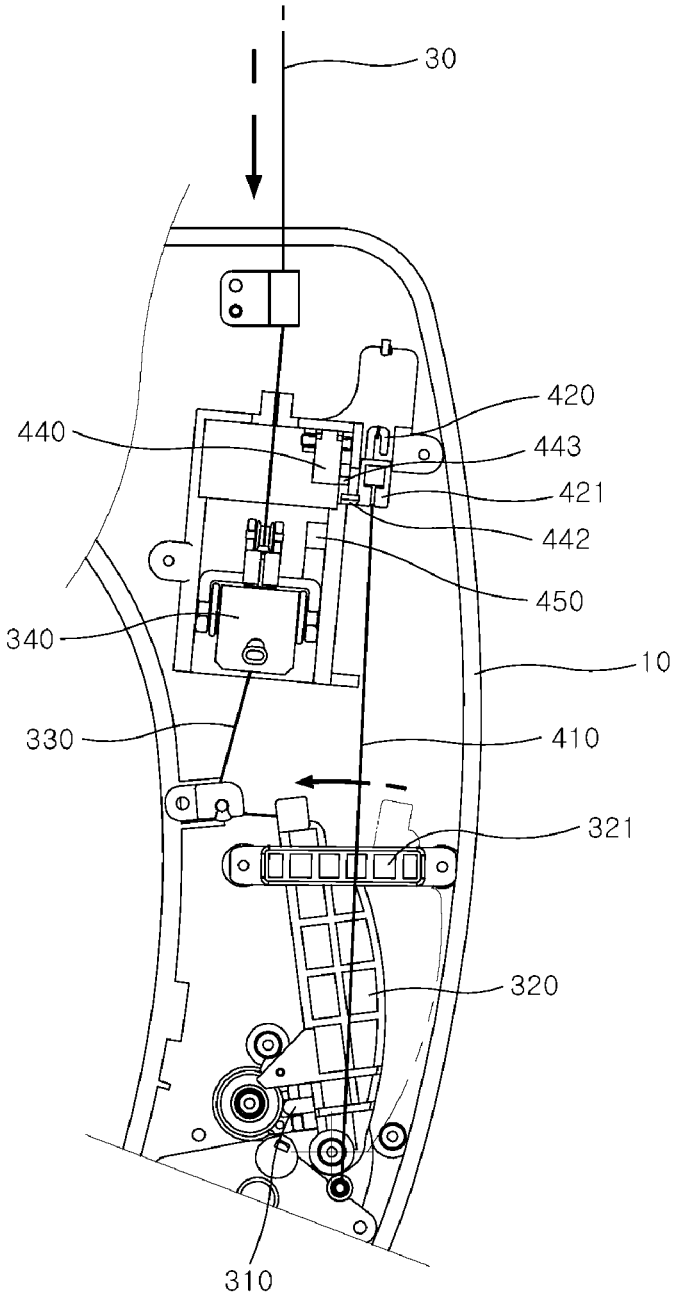
Figure 19:
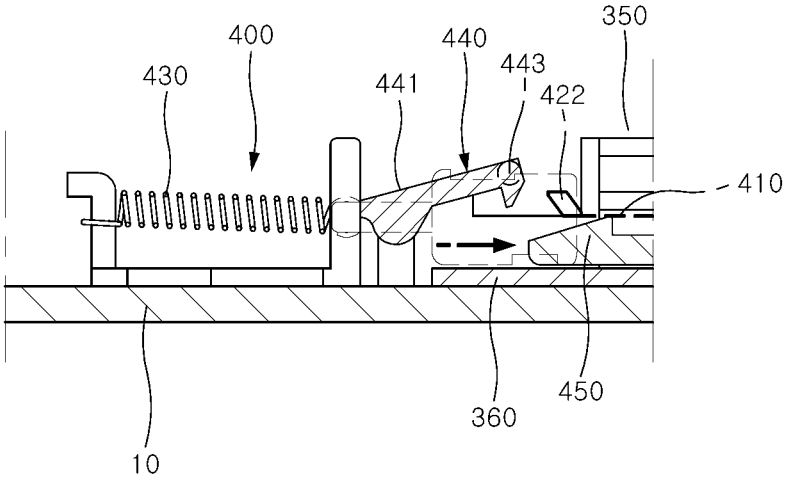
Figure 20:
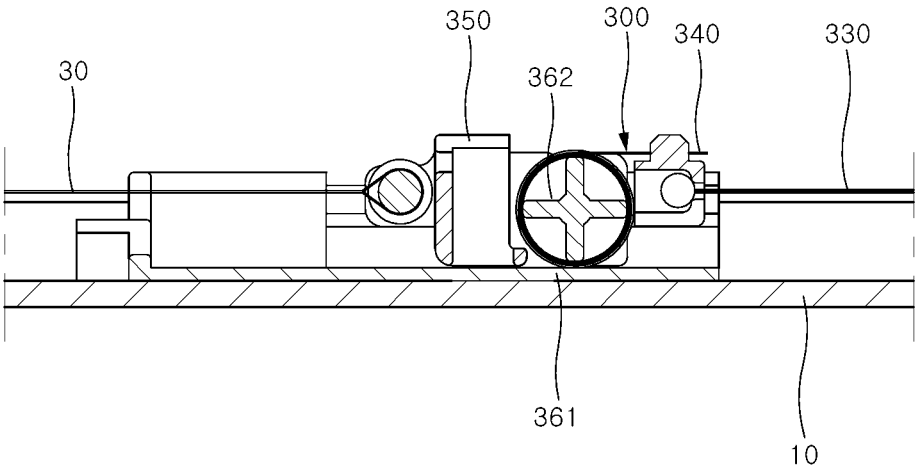

Further, as shown in FIGS. 18 to 20, as the gap between the toilet seat 10 and the body sensing unit 100' is increased by the seat springs 130 of the body sensing unit 100' and accordingly the unloading wire 410 fixed at the first end to the body sensing unit 100' is tensed, the unloading wire-fixing member 420 and the unloading wire-support member 430 are pulled and moved by the tension of the unloading wire 410.

With the movement of the unloading wire-fixing member 420, when the unloading wire projection 422 presses the unloading wire projection 443 of the unloading member 440, the unloading wire projection 443 is moved up along the inclined surface of the unloading wire projection 422 and the unloading projection 442 of the unloading member 440 is separated from the loading projection 450, so the coupling force of the unloading projection 442 and the loading projection 450 is removed.

When the coupling force of the unloading projection 442 and the loading projection 450 is removed, the loading guide 350 and the flushing wire 30 connected to the loading guide 350 are instantaneously pulled and moved by the loading force of the loading member 340, in which the moving guide projection 352 protruding on the loading guide body 351 of the loading guide 350 moves toward the front of the guide body 361 along the guide groove 362 of the loading guide member 360 and the siphon cover 20 fixing the flushing wire 30 opens the exit of an overflow pipe by being rotated upward about the overflow pipe so that the water in a water tank is supplied to the toilet body 10 through the open exit.

Figure 21:
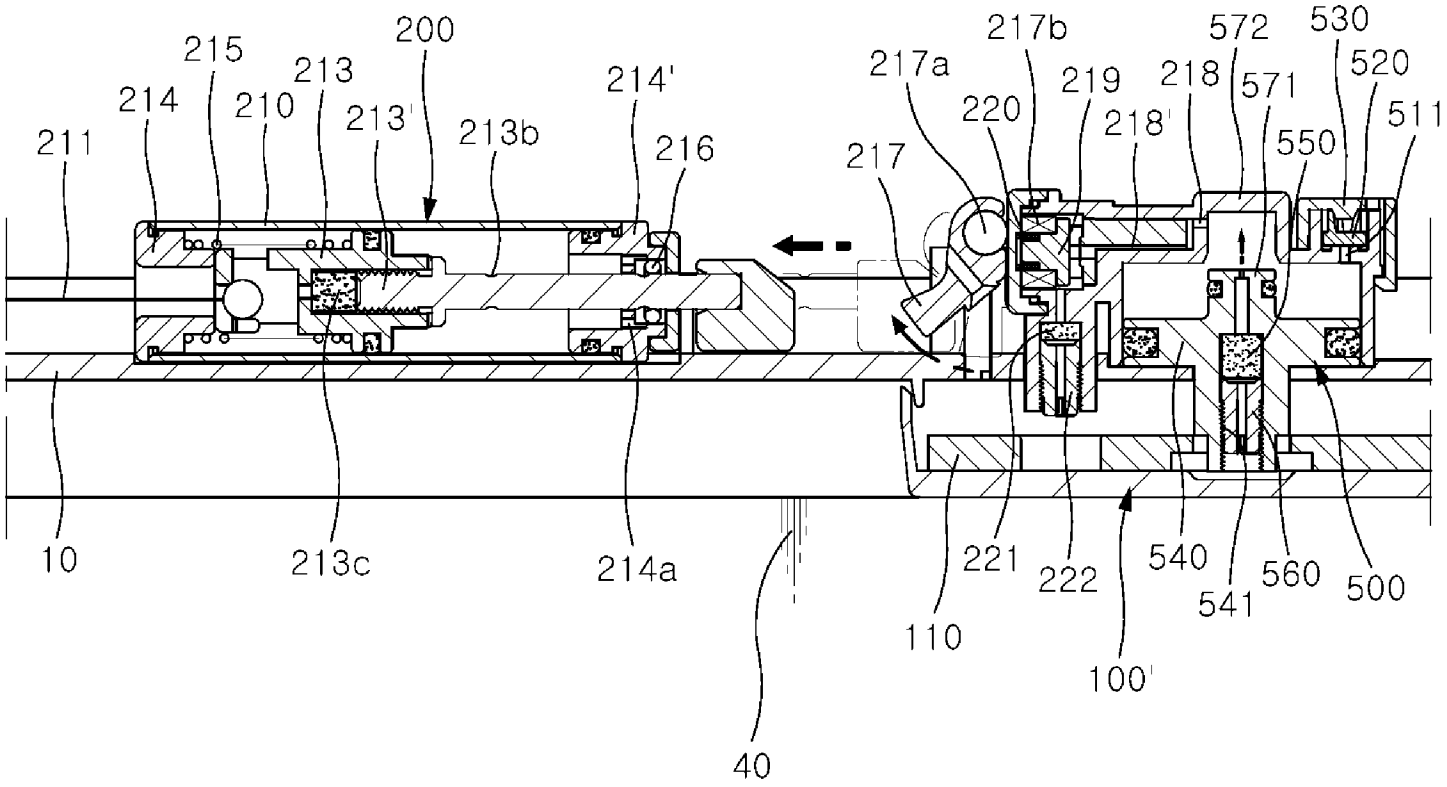

As for the water supplied to the toilet body 10 from the water tank, as shown in FIG. 21, it is possible to adjust the time for the vertical guide member 540 moving to the bottom inside the adjusting body 510 on the basis of the amount of air sucked through the air guide groove 218' and the amount of air sucked through the urine adjusting hole 218 of the urine cover member 219 by closing the urine adjusting hole 218 of the excreta discriminating unit 200, so water corresponding to the excreta of the user discriminated on the basis of whether of contact of the cylinder rod 213' and the excreta mode-switching member 217 can be supplied to the toilet body 10, thereby removing the excreta, when the weight of the user is removed.

Figure 22:
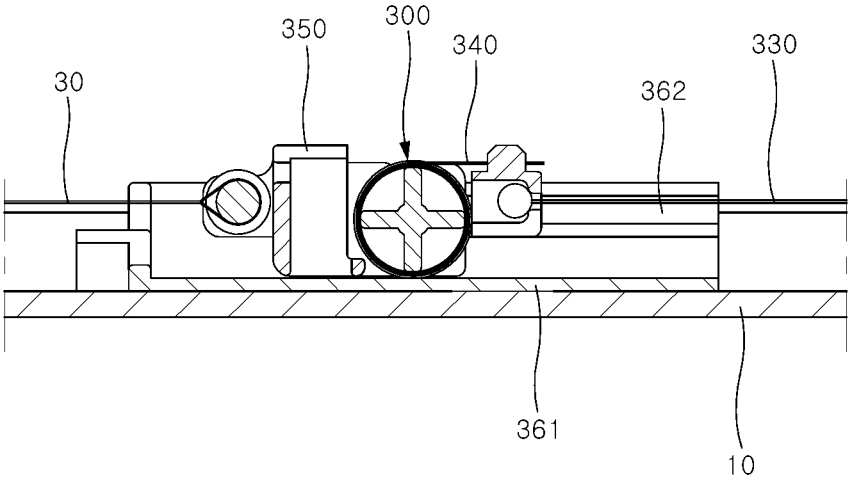
Figure 23:
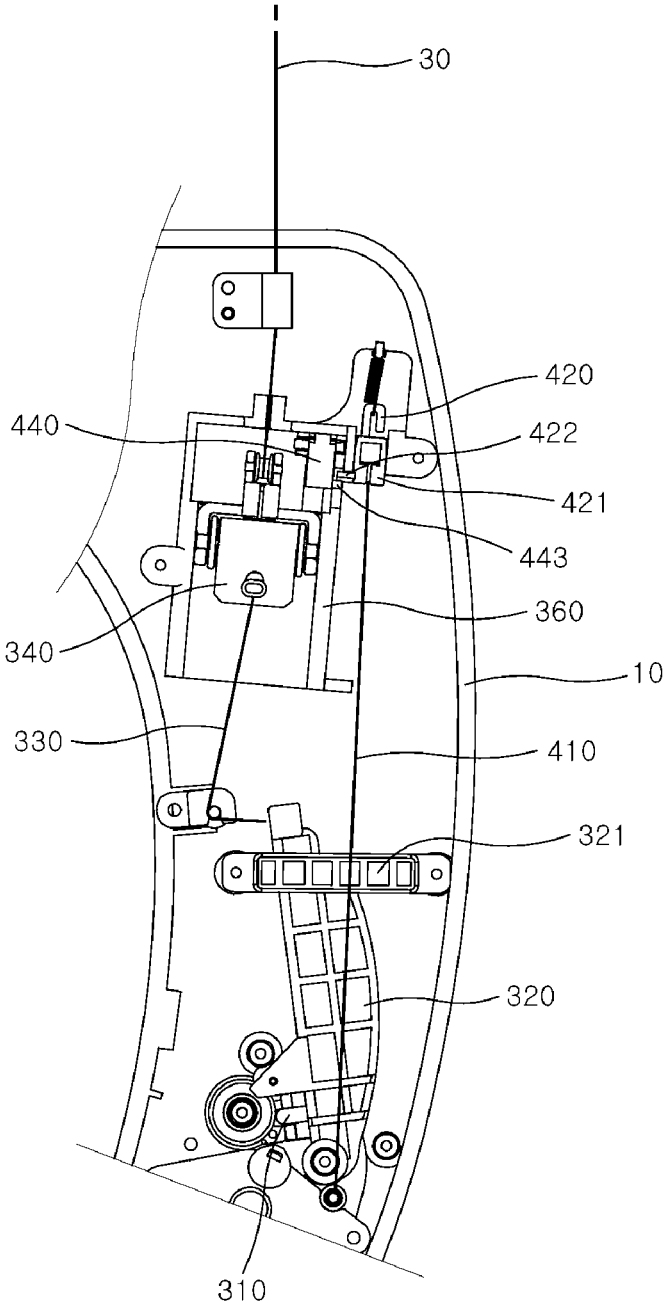

Since the gap between the toilet seat 10 and the body sensing unit 100' has been increased, as the pressing force applied to the lever 320 by the pressing member 310 is removed after the excreta is removed through the process described above, as shown in FIGS. 22 and 23, the siphon cover 20 is rotated downward by its own weight and closes the exit of the overflow pipe, the flushing wire 30 and the loading guide 350 are pulled by the siphon cover 20 rotated downward, and the moving guide projection 352 protruding on the loading guide body 351 is moved to the rear portion of the guide body 361 along the guide groove 362 of the loading guide-guiding member 360.

While the loading guide 350 moves to the rear portion of the loading guide-guiding member 360, the loading projection 450 pushes up the unloading projection 442 of the unloading member 440 and passes the unloading projection 442, and accordingly, the unloading member 440 is moved down by its own weight and the unloading projection 442 and the loading projection 450 are coupled.

Further, while the loading guide 350 is moved to the rear portion of the loading guide-guiding member 360, the loading member 340 is restored by its own elasticity and pulls the loading wire 330 connected to the loading member 340, the loading wire 330 pulls the lever 320 with the pressing force by the pressing member 310 removed, and the lever 320 is rotated from the first side to the second side about the end.

Figure 24:
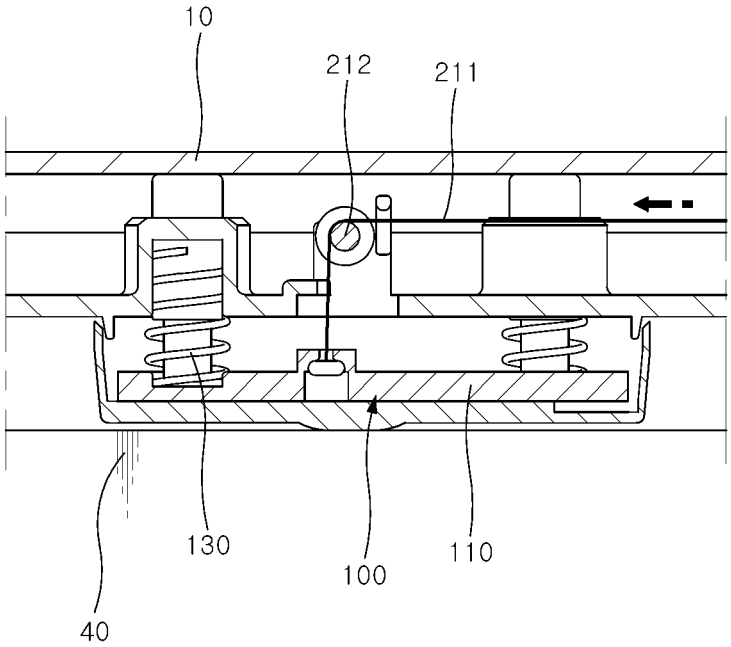

Further, as the gap between the toilet seat 10 and the body sensing unit 100 is increased by the restoring force of the seat springs 130 of the body sensing unit 100 and the cylinder wire 211 is tensed, as shown in FIG. 24, the cylinder spring 215 is compressed and the rod pin 213 and the cylinder rod 213' are pulled and moved by the tension of the cylinder wire 211. Further, when the packing 216 is moved to the coupling groove **213*b'* over the coupling groove 231*b* by the movement of the cylinder rod 213', the inner side of the second cap 214' and the groove 214*a* are opened and air is sucked inside. Furthermore, as the rod pin 213 and the cylinder rod 213' are moved, the air inside the cylinder body 210 is discharged through the air adjusting filter 213*c* and the first cap 214**.

Figure 25:
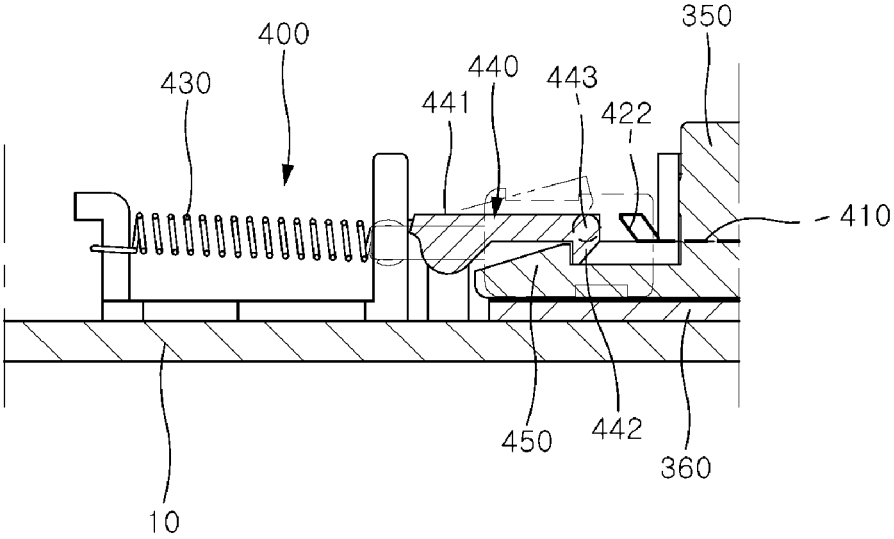
Figure 26:
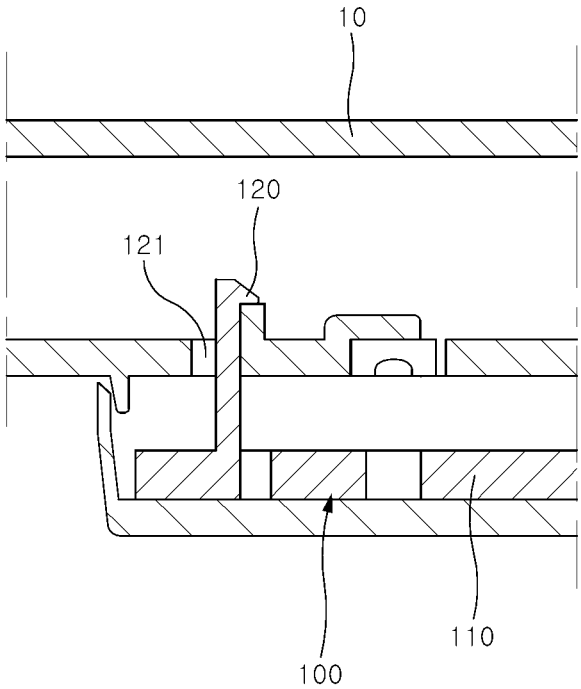

Further, as the gap between the toilet seat 10 and the body sensing unit 100' is increased by the restoring force of the seat springs 130 of the body sensing unit 100' and the unloading wire 410 is tensed, as shown in FIG. 25, the unloading wire-supporting member 430 is stretched and the unloading wire-fixing member 420 is pulled by the tension of the unloading wire 410, so the unloading wire projection 422 is positioned at the end of the unloading wire projection 443. Further, as shown in FIG. 26, as the gap between the toilet seat 10 and the body sensing unit 100 and 100' is increased, the hook 120 is locked into the hook hole 121, thereby standing by the next operation.

The contact members 217*a* and 217*b* may be both magnets, or one of them may be a magnet and the other one may be a metallic part.

Although the present invention was described above with reference to limitative embodiments and drawings, the terminologies and terms used in the specification and claims should not be construed as being limited to common or dictionary meanings, but should be construed as being meanings corresponding to the spirit of the present invention. Therefore, the configurations described in the embodiments and drawings of the present invention are merely most preferable embodiments but do not represent all of the technical spirit of the present invention. Thus, the present invention should be construed as including all the changes, equivalents, and substitutions without departing from the claims.

The invention claimed is:

1. An adjustment unit of an unpowered automatic water flushing toilet bowl seat having a function of controlling air discharge and intake only by a user's body weight, in an automatic flushing device that senses a user through seat springs (130) compressed by the weight of the user when the user sits on a toilet seat (10) and automatically removes excreta using water from a hydrant and a water tank while the toilet seat (10) is restored by restoring force of the seat springs (130) when the user stands up from the toilet seat (10), the adjustment unit (500) comprising:

an adjusting body (510) fixed to the toilet seat (10) and having an air exhaust hole (511);

a cover member (520) opening and closing the air exhaust hole (511);

an anti-separation member (530) preventing separation of the cover member (520);

a vertical guide member (510) fixed to a body sensing unit (100') to discharge air in the adjusting body (510) and suck air outside the adjusting body (510) by moving up and down in the adjusting body (510);

an air adjusting filter (550) coupled to a hole (541) formed through the vertical guide member (540) to adjust the amount of air flowing inside through the hole (541); and a bolt (560) inserted in the hole (541) to prevent separation of the air adjusting filter (550) and adjust the movement amount of the air in accordance with the degree of compression of the air adjusting filter (550).

2. An adjustment unit of an unpowered automatic water flushing toilet bowl seat having a function of controlling air discharge and intake only by a user's body weight, in an automatic flushing device that senses a user through seat springs (130) compressed by the weight of the user when the user sits on a toilet seat (10) and automatically removes excreta using water from a hydrant and a water tank while the toilet seat (10) is restored by restoring force of the seat springs (130) when the user stands up from the toilet seat (10), the adjustment unit (500) comprising:

an adjusting body (510) fixed to the toilet seat (10) and having an air exhaust hole (511);

a cover member (520) opening and closing the air exhaust hole (511);

an anti-separation member (530) preventing separation of the cover member (520);

a vertical guide member (510) fixed to a body sensing unit (100') to discharge air in the adjusting body (510) and suck air outside the adjusting body (510) by moving up and down in the adjusting body (510); and a toilet paper-disposal time adjuster (570) adjusting time for a user to dispose toilet paper.

3. The adjustment unit of claim 2, wherein the toilet paper-disposal time adjuster (570) includes:

a toilet paper time-adjusting rib (571) protruding on a top of the vertical guide member (540);

a rib groove (572) formed on the adjusting body (510) to receive the toilet paper time-adjusting rib (571);

a toilet paper time-adjusting hole (573) formed through the adjusting body (510); and a toilet paper time-adjusting cover member (574) inserted in the toilet paper time-adjusting hole (573) so that the toilet paper time-adjusting rib (571) opens and closes the toilet paper time-adjusting hole (573) by being coupled to and separated from the rib groove (572).

4. The adjustment unit of claim 3, further comprising a restoring member (575) guiding the toilet paper time-adjusting cover member (574) that is restored.

5. The adjustment unit of claim 3, further comprising:

an air adjusting filter (576) coupled to an end of the toilet paper time-adjusting hole (573) to adjust the amount of air sucked through the toilet paper time-adjusting hole (573); and a toilet paper time-adjusting bolt (577) being a hollow body for guiding air, coupling to the toilet paper time-adjusting hole (573), and preventing separation of the air adjusting filter (576).

* * * * *